US006567622B2

(12) United States Patent
Phillips

(10) Patent No.: US 6,567,622 B2
(45) Date of Patent: May 20, 2003

(54) IMAGE FORMING DEVICES AND IMAGE FORMING METHODS

(75) Inventor: Quintin T. Phillips, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/013,733

(22) Filed: Oct. 22, 2001

(65) Prior Publication Data

US 2003/0077086 A1 Apr. 24, 2003

(51) Int. Cl.[7] ..... G03G 15/00
(52) U.S. Cl. ..... 399/24; 399/27
(58) Field of Search ..... 399/14, 82, 24–29

(56) References Cited

U.S. PATENT DOCUMENTS

| | | | | |
|---|---|---|---|---|
| 4,627,715 A | * | 12/1986 | Kikuno | 399/27 |
| 4,951,091 A | * | 8/1990 | Nawata | 399/27 |
| 5,021,826 A | * | 6/1991 | Maruta | 399/24 |
| 5,095,331 A | * | 3/1992 | Takano | 399/27 X |
| 5,204,698 A | | 4/1993 | LeSueur et al. | |
| 5,349,377 A | | 9/1994 | Gilliland et al. | |
| 5,491,540 A | | 2/1996 | Hirst | |
| 5,621,221 A | | 4/1997 | Shinohara et al. | |
| 5,655,174 A | | 8/1997 | Hirst | |
| 5,850,583 A | | 12/1998 | Song et al. | |
| 5,867,198 A | | 2/1999 | Gwaltney et al. | |
| 5,970,275 A | | 10/1999 | Brown, Jr. et al. | |
| 6,128,448 A | | 10/2000 | Arcaro et al. | |
| 6,275,664 B1 | * | 8/2001 | Wolf et al. | 399/27 X |

FOREIGN PATENT DOCUMENTS

| | | |
|---|---|---|
| EP | 0780786 A2 | 6/1997 |
| GB | 2368698 | 5/2002 |

* cited by examiner

*Primary Examiner*—William J. Royer

(57) ABSTRACT

Image forming devices and image forming methods are described. One aspect provides an image forming device including an image engine configured to use a consumable to image a job; and processing circuitry coupled with the image engine and configured to monitor for an occurrence of a predetermined status of the consumable during imaging of the job and to select one of first ceasing imaging of the job before completion of the imaging of the job and second ceasing imaging of the job after completion of the imaging of the job, wherein the processing circuitry is configured to select one of the first ceasing and the second ceasing responsive to the monitoring of the predetermined status of the consumable.

20 Claims, 2 Drawing Sheets

IMAGE FORMING DEVICES AND IMAGE FORMING METHODS

FIELD OF THE INVENTION

This invention relates to image forming devices and image forming methods.

BACKGROUND OF THE INVENTION

Image forming devices including laser printers and ink printers are known in the art. Such devices utilize consumables, such as toner cartridges, to implement imaging operations. Some conventional devices include consumable management systems which include toner level sensors to provide a means for determining a remaining amount or life of a consumable. One of the goals of consumable management systems is to prevent printing of images or documents with poor print quality due to a lack of consumables. For example, poor print quality may result from printing of pages with fade induced by a lack of toner. Such has heightened importance in color printing where a lack of one color of toner can result in an entire image having unacceptable print quality. If images are higher coverage and/or are printed on expensive media, printing with insufficient toner may result in the loss of a large amount of resource and money of the customer.

In conventional systems and upon indication of a low consumable, a print job could be attempted to be completed, the current printing page could be completed, or the printer could be immediately stopped. In conventional systems, the printing option upon occurrence of a low consumable is preselected and all jobs are imaged according to the preselection upon a low consumable. These options have issues which may produce dissatisfaction with customers. For example, if there is an attempt to complete a print job and the job is large or high coverage, print quality degradation may result in succeeding pages. If the consumable is changed after printing the end of a current page, the risk of print quality degradation due to insufficient resources is reduced but the risk of hue shift due to the utilization of new and old toner exists. If the printer stops immediately upon indication of low consumable status, there is a risk of frustrating the customer as the end of life signal may not be exact and there is a high probability of having sufficient resource, such as toner, remaining in the printer to complete all or some portion of the print job despite the indication of the low consumable status.

Prior solutions to this problem have included providing more sensitive sensing systems. This solution requires increased expense in the printing system inasmuch as a highly accurate toning sensing system are relatively expensive. Other conventional systems incorporate a secondary sensing system which also results in increased costs.

Accordingly, improved devices in methodologies for imaging are desired.

SUMMARY OF THE INVENTION

Image forming devices and image forming methods are disclosed. One aspect of the invention provides an image forming device comprising: an image engine configured to use a consumable to image a job; and processing circuitry coupled with the image engine and configured to monitor for an occurrence of a predetermined status of the consumable during imaging of the job and to select one of first ceasing imaging of the job before completion of the imaging of the job and second ceasing imaging of the job after completion of the imaging of the job, wherein the processing circuitry is configured to select one of the first ceasing and the second ceasing responsive to the monitoring of the predetermined status of the consumable.

Another aspect provides an image forming method comprising: imaging at least a portion of a job comprising a plurality of hard images using a consumable; monitoring for an occurrence of a predetermined status of the consumable; and selecting one of first ceasing imaging of the job after a completion of imaging of a hard image being imaged during the occurrence of the predetermined status and second ceasing imaging after a completion of the imaging of the job, the selecting being responsive to the monitoring.

According to another aspect, an image forming method comprises: providing a job comprising image data corresponding to a plurality of hard images; imaging at least one of the hard images using a consumable and corresponding to a first portion of the job, the imaging comprising imaging using an image forming device; detecting an occurrence of a predetermined status of the consumable during the imaging of the first portion of the job; analyzing a requirement amount of the consumable to complete imaging of a second portion of the job with respect to the predetermined status of the consumable after the detecting; providing a plurality of options for imaging the second portion of the job using the image forming device; and selecting one of the imaging options for imaging the second portion of the job responsive to the analyzing.

The invention includes other aspects, some of which are disclosed below.

DETAILED DESCRIPTION OF THE INVENTION

Figure 1:
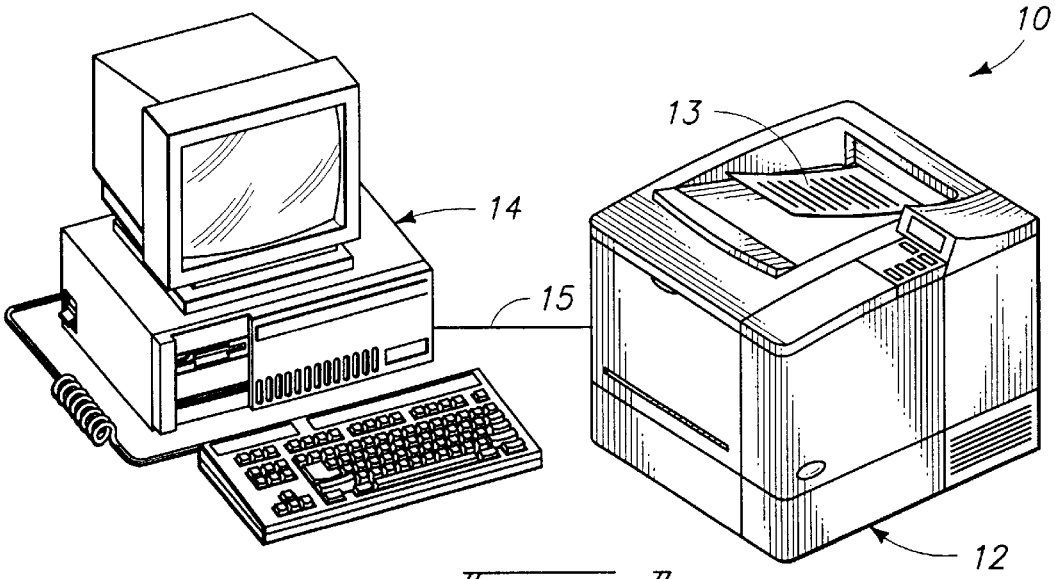
FIG. 1 is an illustrative representation of an exemplary image forming system.

FIG. 1 depicts an exemplary image forming system including one or more image forming device 12 and one or more host device 14 (only one image forming device 12 and one host device 14 are depicted in the arrangement, of FIG. 1). Image forming device 12 and host device 14 are configured to communicate via an appropriate medium 15 including for example, a network, parallel connection, or the like.

Image forming device 12 utilizes one or more consumable to form hard images. Exemplary consumables utilized within a given image forming device include imaging media 13 (e.g., paper, transparencies, roll media), marking agents (e.g., toner, ink), components having fixed life spans (e.g., developer assembly) and other expendable items utilized to complete desired jobs.

Exemplary image forming devices 12 include printers, facsimile devices, copiers, multiple-function devices or other devices capable of forming hard images upon media 13. Exemplary hard images include images provided upon output media and comprise printed media in one example.

An exemplary host device 14 is implemented as a personal computer having an Intel(TM) processor or AMD(TM)

processor (not shown). Host device 14 provides image data to be imaged to image forming device 12 in the exemplary embodiment. Host device 14 may also be utilized to reconfigure or control operations of image forming device 12. Other host device 14 configurations are possible and image data may be provided from other sources (e.g., from a network device) in other embodiments of the invention. In some instances, image data may be generated or otherwise originated internally of image forming device 12.

Figure 2:
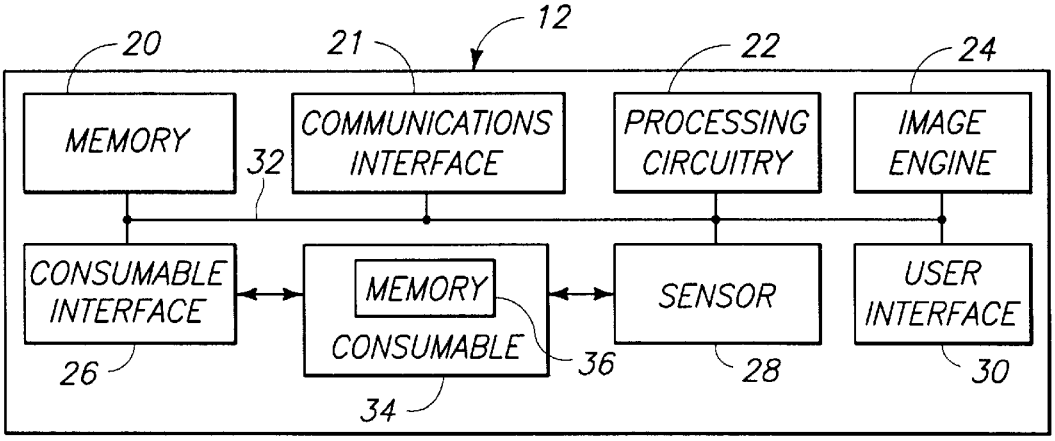
FIG. 2 is a functional block diagram depicting components of an exemplary image forming device of the image forming system.

Referring to FIG. 2, components of an exemplary image forming device 12 are depicted. Some of the depicted components are optional and other arrangements of image forming device 12 configured to form hard images are possible. The exemplary embodiments disclosed herein are discussed with reference to a printer application although the present invention applies to any image forming device configuration capable of forming hard images.

As shown, the exemplary image forming device 12 includes a memory 20, a communications interface 21, processing circuitry 22, an image engine 24, a consumable interface 26, a sensor 28 and a user interface 30. A bus 32 is configured to implement bidirectional communications between the respective components of image forming device 12.

Memory 20 is configured to store executable instructions configured to cause processing circuitry 22 to control operations of image forming device 12. Memory 20 is further configured to store digital data usable within image forming device 12. For example, memory 20 is configured to store image data to be imaged using image engine 24, executable instructions usable by processing circuitry 22 to implement imaging operations and to control operations of image forming device 12, as well as other digital data to be stored within image forming device 12. Exemplary memory comprises a hard disk, random access memory (RAM), read only memory (ROM) and/or flash memory in but one exemplary embodiment.

Communications interface 21 is arranged to implement communications of image forming device 12 with external components, such as host device 14, private and or public networks (not shown). In exemplary configurations, communications interface 21 is implemented as a modem or a network interface card (NIC) to implement external communications.

Processing circuitry 22 is configured to execute executable instructions to control operations of image forming device 12. Processing circuitry 22 is configured to implement operations described herein with respect to monitoring consumable usage and selecting imaging options responsive to such monitoring. Processing circuitry 22 is configured to execute executable instructions stored within memory 20 comprising, for example, software and/or firmware instructions. An exemplary configuration of processing circuitry 22 is a microprocessor.

Image engine 24 implements formation of hard images upon media 13. According to the exemplary described printer embodiment, image engine 24 is implemented as a print engine. An exemplary print engine includes a developing assembly and a fuser assembly (not shown) to respectively form hard images using marking or developing agents and to affix the agents to media 13. Other constructions or embodiments of image engine 24 are possible.

Consumable interface 26 is configured to couple with a consumable 34 to establish communications therewith. An exemplary consumable 34 includes a memory 36 to store digital information. Exemplary memory 36 includes RAM, flash memory or other configurations. Consumable 34 may be implemented as a toner cartridge including a memory tag, for example. In other configurations, consumable 34 does not include memory 36.

Consumable interface 26 is utilized to write data to memory 36 of consumable 34 and to retrieve data therefrom. Exemplary communications between consumable interface 26 and consumable 34 are described in U.S. Pat. No. 5,491,540, which is incorporated herein by reference.

Sensor 28 is configured to monitor a status of consumable 34 and to output information regarding the status to processing circuitry, 22 or other appropriate components. Sensor 28 may be configured to weigh the consumable 34, optically monitor a remaining amount of consumable 34 or monitor the status of consumable 34 in any appropriate method. Additionally or alternatively, processing circuitry 28 may be utilized to monitor a status of consumable 34 by counting pixels during generation of images, for example. In such an arrangement, sensor 28 may be omitted from image forming device 12. Although only one sensor 28 and consumable 34 are depicted in the exemplary configuration, additional different consumables 34 of image forming device 12 may be monitored using one or more sensor 28 in other arrangements.

User interface 30 is implemented as a control panel and a display in the described embodiment. A user inputs commands and other information via the control panel and processing circuitry 22 controls the display to depict status and other messages pertinent to image forming device 12 (the control panel and display of user interface 30 are not shown). A user interface may be implemented using software resident upon the host device 14 in another arrangement to allow a user to input commands and other information.

Aspects of the present invention provide monitoring status of one or more consumable and controlling operations of the image forming device 12 responsive thereto. A status of consumable 34 being monitored corresponds to the type of the consumable and may be indicated in any convenient way to indicate expended or remaining capacity or life of the consumable (e.g., weight of the consumable, hours of useful life of the consumable).

In one exemplary implementation, a job to be imaged is initially analyzed prior to imaging or at another convenient time to determine the job requirements to complete imaging of the job. Such analysis of job requirements may be performed either within host device 14 or using image forming device 12 and indicates for example the number of pages to be imaged for the job, predicted amount of a consumable to be used to complete the job, as well as other desired information. Further details of exemplary analysis of job requirements is discussed in U.S. patent application Ser. No. 09/824,902, titled Systems and Methods of Analyzing a Print Job, filed Apr. 2, 2001, listing Mark A. Harper as inventor, and incorporated herein by reference. If performed within image forming device 12, processing circuitry 22 is configured to perform the job requirement analysis in one configuration.

According to additional aspects of the present invention, the user may provide a value (e.g., 0% to 100%) indicating a confidence level or desirability to successfully complete imaging of the job. Such value may be inputted using user interface 30, host device 14 or other appropriate input device. If a value is not inputted, a default value may be utilized if desired.

For embodiments utilizing such desirability value, the value indicates the confidence level in a percentage for probability of success for completing the job having acceptable image quality. For example, a user may indicate a low probability of successful quality printing (e.g., 25% value) if the print quality of the particular job is not of significant importance to the user. For example, the user may indicate a low value when printing e-mails, drafts, internal memoranda or other jobs wherein image quality is not of significant importance.

Similarly, if image quality of the job is of significant importance, or for other reasons, the user may indicate a higher confidence or probability value such as 95%. The higher value would indicate image quality of, the job is of increased importance to this particular user and the image forming system 10 operates to assure that optimal image quality is provided if a higher confidence or probability value is selected. If a desirability value is provided, the value may be provided in the job ticket associated with the respective job in one possible configuration. In other configurations, probability values are not utilized.

Aspects of the invention provide monitoring of a status of one or more consumable. A predetermined status of a particular consumable is selected by the user or may be a default value. The predetermined status is selected to indicate a "low" or "out" status of the respective consumable in some embodiments of the invention. Upon detection of the status of the consumable reaching the predetermined status, operations disclosed herein may be performed to provide increased customer satisfaction when a "low" or "out" status of consumable 34 is encountered during imaging of a job.

As mentioned above, a sensor 28 is provided to monitor a status of consumable 34 in one exemplary embodiment. Processing circuitry 22 communicates with sensor 28 to monitor the status of the respective consumable 34. In other embodiments, processing circuitry 22 may independently monitor or approximate usage of consumable 34 by analyzing jobs being imaged within image engine 24. For example, processing circuitry 22 may monitor the number of pixels imaged on a given sheet of media to monitor consumable usage. Other possible arrangements or methodologies are possible for monitoring a status of a consumable 34.

Aspects of the invention provide a plurality of imaging options for imaging a job being imaged during detection of the predetermined status of the consumable 34. As utilized herein, a portion of a job image before the detection of the consumable 34 reaching the predetermined status may be referred to as a first portion while the remaining portion of the job to be imaged following the detection of the predetermined status of consumable 34 may be referred to as a second or subsequent portion. According to aspects of the invention, a plurality of options for imaging the second portion of the job are provided upon consumable 34 reaching the predetermined status. In the exemplary embodiment, processing circuitry 22 selects one of the plurality of imaging options for imaging the second portion of the job as described in further detail below.

A first option upon detection of the predetermined status is to proceed with imaging of the second or subsequent portion of the job before replenishment of the consumable 34. Another option is to cease imaging of the job following completion of imaging of the hard image (e.g., sheet of media) being imaged upon detection of the occurrence of the predetermined status of the consumable 34. Yet another option is to immediately cease operation or imaging of the job upon detection of the predetermined status of the consumable 34. Accordingly, some of the options provide ceasing imaging of the job before completion of the imaging of the job (ceasing imaging of the job after imaging the first portion of the job and before imaging a second portion of the job) and other aspects provide ceasing imaging of the job after completion of the job. According to some aspects, imaging of the job resumes (if the job was not previously completed imaged) once consumable 34 is replenished.

Processing circuitry 22 or another appropriate device selects an appropriate imaging option with respect to completion of imaging of the job responsive to monitoring of a status of consumable 34 and following a detection of the consumable reaching the predetermined status. According to one aspect of the invention, processing circuitry 22 analyzes a requirement amount of consumable to complete imaging of the second portion of the job with respect to the predetermined status of the consumable (which corresponds to the current remaining amount of the consumable).

In one embodiment, the requirement amount of the consumable is determined using host device 14 or image forming device 12 upon initiation of the job as described above. During imaging of the first portion of the job, processing circuitry 22 or other appropriate device monitors how many pages have been imaged. Accordingly, upon detection of the consumable reaching the predetermined status, processing circuitry 22 can determine a requirement amount of the consumable to complete imaging of the second portion of the job by subtracting the number of sheets or pages of media already imaged from the original number of pages of the job to determine how many sheets or pages remain to be imaged in the job and or how much of the consumable will be utilized to complete imaging of the second portion of the job.

Analyzing the requirement amount of the consumable to complete imaging of the second portion of the job with respect to the predetermined status of the consumable comprises subtracting the requirement amount of the consumable from the predetermined status to determine if the current consumable amount exceeds the remaining job requirements. Accordingly, in one aspect, the analysis comprises a sum difference of the requirement amount of the consumable to complete imaging of the job compared with the predetermined status of the consumable. In one arrangement, processing circuitry 22 is configured to select the imaging option of ceasing imaging of the job before completion of the job (e.g., after imaging the sheet of media being imaged upon occurrence of the predetermined status of consumable 34) responsive to the requirement amount of the consumable exceeding the current amount of the consumable.

According to another aspect of the invention, statistical analysis may be utilized to select the appropriate option for completion of imaging of the job. Exemplary statistical analysis is described in the U.S. patent application Ser. No. 09/602,640, titled Image Forming Systems and Methods of Forming an Image, filed Jun. 22, 2000, listing Quintin T. Phillips, Darius Brockholdt, Mark A. Harper and Robert E. Haines as inventors, and incorporated herein by reference.

As mentioned above, a value may be associated with the job (e.g., the value is provided in the job ticket in the described exemplary arrangement and indicates the confidence level of the user for having the job successfully imaged with acceptable image quality). Processing circuitry 22 is configured to access the value from the job ticket or other appropriate location to select the appropriate option for completion of imaging of the second portion of the job.

The value may be utilized in the exemplary formula disclosed in U.S. patent application Ser. No. 09/602,640 to determine the probability of successful completion of imaging of an image job using a confidence value or level selected by a user. Other statistical analysis may be utilized in other embodiments.

Responsive to the analysis of the requirement amount of the consumable and the predetermined status of the consumable using the above or other methods, processing circuitry 22 operates to select one of the imaging options for completion of imaging of the second portion of the job. If it is determined with satisfactory confidence as determined by the received value that the job will be completed, processing circuitry 22 proceeds to attempt to image the second portion of the job and thereafter ceases imaging. Alternatively, if insufficient confidence exists that the job will be completed, processing circuitry 22 ceases imaging of the job before completing imaging of the second portion of the job. In one embodiment the hard image being imaged during the occurrence of the predetermined status is completed and processing circuitry 22 thereafter ceases further imaging of the job using image engine 24 awaiting replenishment of the consumable 34.

Imaging of the job using image forming device 12 is resumed upon appropriate replenishment of consumable 34. In one arrangement, all imaging of image forming device 12 is ceased until the consumable 34 is replenished. According to other aspects, image forming device 12 may be configured to analyze other pending jobs or jobs received in the future to determine if those jobs may be selectively individually imaged prior to replenishment of the consumable 34 (e.g., if the requirement amount and current amount of the consumable indicate imaging is appropriate and that imaging of such a job may be completed based upon the status of consumable 34).

According to additional aspects of the invention, processing circuitry 22 is configured to indicate the status of consumable 34 reaching the predetermined status. For example, processing circuitry 22 may control user interface 30 to indicate a "low consumable" message. Alternatively, or in addition, processing circuitry 22 may formulate a message for communication to host device 14 to depict the consumable status indication. Other forms of communicating the status of consumable 34 may include formulating an e-mail message or other communication to be applied to an appropriate external device coupled with image forming device 12.

Figure 3:
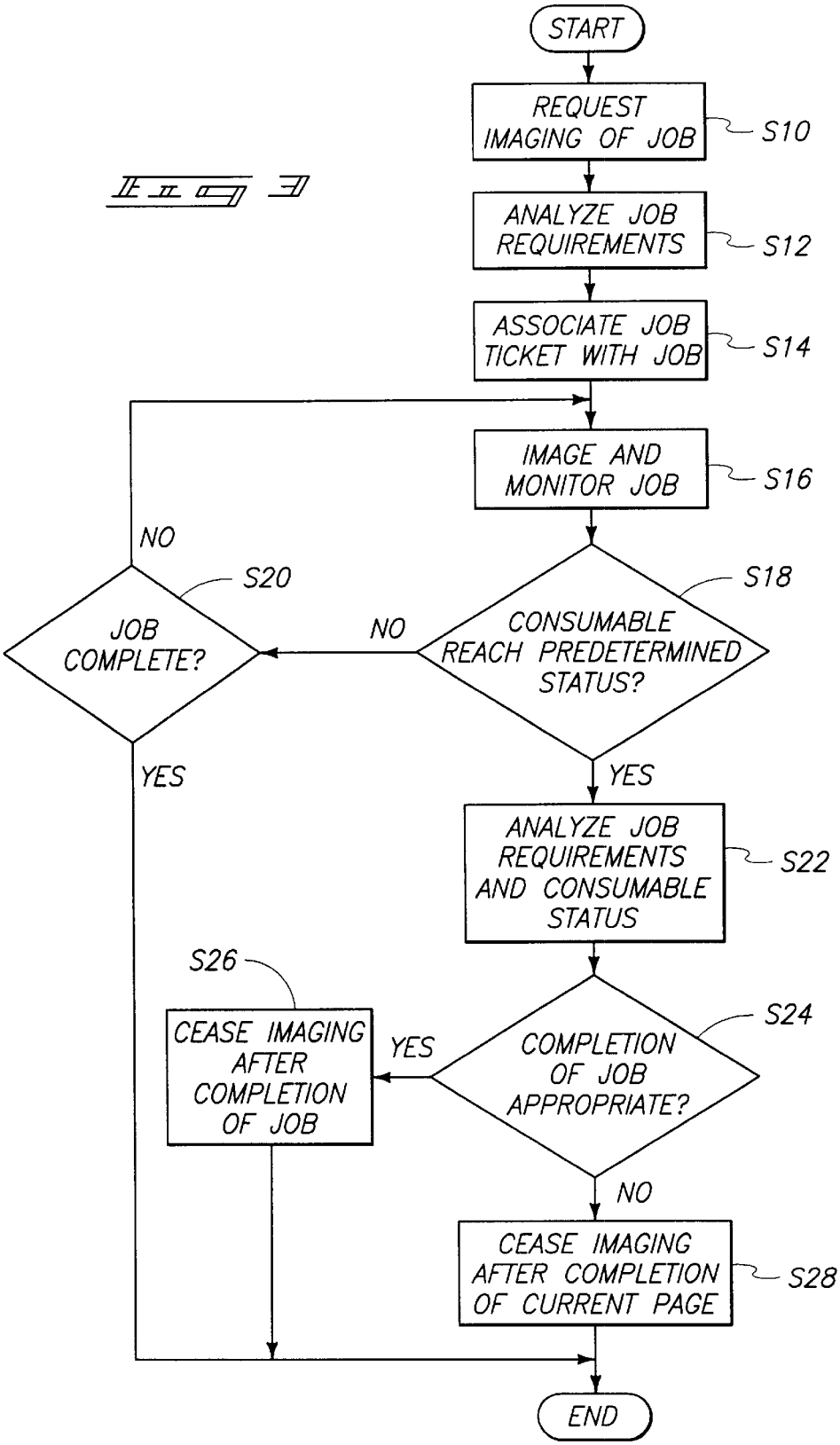
FIG. 3 is a flow chart depicting an exemplary method for imaging a job.

Referring to FIG. 3, an exemplary methodology performed within image forming device 12 and/or host device 14 is illustrated. For example, executable instructions which cause implementation of the depicted methodology may be stored within memory 20 of image forming device 12 and or memory of host device 14 (not shown). Steps performed within image forming device 12 may be executed by processing circuitry 22. Steps performed within host device 14 may be executed by an appropriate processor (not shown).

Initially, at step S10, a job is requested. In one embodiment, the request is submitted via a print driver of host device 14. The image job comprises image data corresponding to a plurality of hard images.

At a step S12, job requirements for the job being requested are analyzed by image forming device 12 and/or host device 14.

At step S14, the job ticket is associated with the job. The job ticket includes the job requirements and/or the user acceptable probability/confidence levels or values if provided. If step S14 is performed within host device 14, the job and associated job ticket are communicated via medium 15 to image forming device 12.

At step S16, image forming device 12 begins to image the job and monitors imaging of the job. In the described printer embodiment, the image engine 24 operates to print hard images upon media 13.

At step S18, image forming device 12 monitors for the occurrence of the consumable reaching the predetermined status.

If the condition of step S18 is negative, it is determined whether the job is completed at step S20.

If not, the method returns to step S16. If the condition of step S20 is affirmative, the depicted methodology ends.

If the condition of step S18 is affirmative, image forming device 12 operates to analyze the job requirements and the consumable status at step S22 as described above. In exemplary configurations, the analysis may be a simple sum difference, statistical determination or other appropriate analysis of a consumable requirement amount to complete the job and a current amount of the consumable as described above.

At step S24, image forming device 12 determines whether completion of the job is appropriate based upon the analysis of step S22 using the job requirements and the consumable status.

If the condition of step S24 is affirmative, image forming device 12 operates to continue imaging the job and ceases imaging after completion of the job at step S26.

If the condition of step S24 is negative, image forming device 12 ceases imaging after completion of imaging of the current page at step S28.

One example of the methodology is described hereafter with respect to a color imaging job. Typically, image forming device configurations for implementing color imaging utilize a plurality of different colors of toner, ink or other marking agent.

In one example, the host requires printing of three copies of a calendar, for example. Analysis of the job requirements is performed by the appropriate host device 14 or image forming device 12. Accordingly, requirements of three by twelve pages is placed within a respective job ticket and an exemplary confidence value of 95% probability of success is assigned to the job by the user. The ticket and the job are thereafter sent to the image forming device 12 if the requirements analysis is performed by host device 14. Image forming device 12 configured as a color printer begins to print the job.

In this described example, image forming device 12 detects a yellow toner out status from the yellow toner sensor after printing ten pages of the job. Image forming device 12 compares the requirement amount of consumable for the remaining twenty-six pages to be printed to the current amount of yellow toner remaining.

Image forming device 12 thereafter determines whether the anticipated yellow toner cartridge amount remaining is greater than the amount of yellow toner required to finish the job. If the amount remaining exceeds the amount required to finish the job, image forming device 12 proceeds to complete printing of the job. If the required amount to finish the job exceeds the anticipated amount of yellow toner remaining, the printer is stopped at the end of the current page.

Accordingly, a plurality of imaging options are provided responsive to the occurrence of the status of a consumable reaching a predetermined level or status. In one aspect, it is determined whether the job can be completed with a desired degree of confidence. If so, image forming device 12 ceases imaging at the end of the job. If the amount of the consumable required to complete the job is greater than the current amount of the consumable available, the imaging is stopped at the end of the current page. The adaptive behavior based upon job requirements and appropriate analysis provides increased customer satisfaction without adding expenses to the image forming device 12.

What is claimed is:

1. An image forming device comprising:

an image engine configured to use a consumable to image a job; and processing circuitry coupled with the image engine and configured to monitor for an occurrence of a predetermined status of the consumable during imaging of the job and to select one of first ceasing imaging of the job before completion of the imaging of the job and second ceasing imaging of the job after completion of the imaging of the job, wherein the processing circuitry is configured to select one of the first ceasing and the second ceasing responsive to the monitoring of the predetermined status of the consumable.

2. The device of claim 1 wherein the processing circuitry is configured to access a value indicating a desirability to complete imaging of the job, and to select one of the first ceasing and the second ceasing using the value.

3. The device of claim 1 wherein the first ceasing comprises ceasing after a completion of imaging of a hard image being imaged during the occurrence of the predetermined status.

4. The device of claim 1 wherein the processing circuitry is configured to determine a requirement amount of the consumable to complete the job after the occurrence of the predetermined status, and to select one of the first ceasing and the second ceasing responsive to the determination.

5. The device of claim 4 wherein the processing circuitry is configured to select the first ceasing responsive to the requirement amount exceeding the predetermined status.

6. The device of claim 1 wherein the processing circuitry is configured to control an indication of the occurrence of the predetermined status of the consumable.

7. The device of claim 1 wherein the image engine comprises a print engine.

8. An image forming method comprising:

imaging at least a portion of a job comprising a plurality of hard images using a consumable;

monitoring for an occurrence of a predetermined status of the consumable; and selecting one of first ceasing imaging of the job after a completion of imaging of a hard image being imaged during the occurrence of the predetermined status and second ceasing imaging after a completion of the imaging of the job, the selecting being responsive to the monitoring.

9. The method of claim 8 further comprising accessing a value indicating a desirability to complete imaging of the job, and wherein the selecting comprises selecting one of the first ceasing and the second ceasing using the value.

10. The method of claim 8 further comprising determining a requirement amount of the consumable to complete the job after the occurrence of the predetermined status, and wherein the selecting comprises selecting one of the first ceasing and the second ceasing responsive to the determining.

11. The method of claim 10 wherein the selecting comprises selecting the first ceasing responsive to the requirement amount exceeding the predetermined status.

12. The method of claim 8 wherein the imaging comprises printing.

13. The method of claim 8 further comprising indicating the occurrence of the predetermined status of the consumable.

14. An image forming method comprising:

providing a job comprising image data corresponding to a plurality of hard images;

imaging at least one of the plurality of hard images using a consumable and corresponding to a first portion of the job, the imaging comprising imaging using an image forming device;

detecting an occurrence of a predetermined status of the consumable during the imaging of the first portion of the job;

analyzing a requirement amount of the consumable to complete imaging of a second portion of the job with respect to the predetermined status of the consumable after the detecting;

providing a plurality of options for imaging the second portion of the job using the image forming device; and selecting one of the plurality of options for imaging the second portion of the job responsive to the analyzing.

15. The method of claim 14 wherein the providing a plurality of options for imaging comprises providing a first of the plurality of options for imaging comprising ceasing imaging of the job after imaging the first portion of the job, and providing a second of the plurality of options for imaging comprising ceasing imaging of the job after imaging the second portion of the job.

16. The method of claim 14 wherein the providing a plurality of options for imaging comprises providing a first of the plurality of options for imaging comprising ceasing imaging of the job after imaging the first portion of the job and before imaging the second portion of the job.

17. The method of claim 16 wherein the ceasing comprises ceasing responsive to the analyzing indicating that the requirement amount of the consumable exceeds the predetermined status of the consumable.

18. The method of claim 14 further comprising providing a value indicating a desirability to complete the job, and wherein the analyzing comprises analyzing using the value.

19. The method of claim 14 further comprising indicating the predetermined status of the consumable.

20. The method of claim 14 wherein the imaging comprises printing at least one of the hard images.

* * * * *